US005259490A

United States Patent [19]

Gardellini

[11] Patent Number: 5,259,490

[45] Date of Patent: Nov. 9, 1993

[54] ANTIFRAUD CURRENCY ACCEPTOR

[75] Inventor: Maria Gardellini, Commack, N.Y.

[73] Assignee: Coin Bill Validator, Inc., Deer Park, N.Y.

[21] Appl. No.: 771,188

[22] Filed: Oct. 4, 1991

[51] Int. Cl.[5] ..... G07D 7/00

[52] U.S. Cl. ..... 194/203; 194/207; 194/351

[58] Field of Search ..... 194/203, 206, 207, 351

[56] References Cited

U.S. PATENT DOCUMENTS

| | | | |
|---|---|---|---|
| Re. 29,796 | 10/1978 | Yamamoto et al. | 194/351 X |
| 4,513,439 | 4/1985 | Gorgone et al. | 194/206 X |
| 4,884,671 | 12/1989 | Gardellini | 194/207 |

*Primary Examiner*—F. J. Bartuska
*Attorney, Agent, or Firm*—Bauer & Schaffer

[57] ABSTRACT

A paper currency acceptor is provided having an antifraud device comprising a linear actuator having an armature selectively moveable between two positions along its longitudinal axis, the actuator being mounted so that the longitudinal axis of the armature is oriented perpendicularly to the planar surface of the currency passageway. An elongated stop comb is mounted directly to the end of the armature nearest the passageway, the stop comb having a plurality of elongated parallel tines extending therefrom perpendicularly toward the planar surface of the passageway. The tines of the comb are arranged in at least one row along the longitudinal axis of the comb, and the longitudinal axis of the comb is oriented transversely to the longitudinal axis of the passageway. The planar members defining the passageway each have an aperture aligned with the longitudinal axis of each tine. When the actuator position is selected extending the armature, the tines of the comb are pushed through the planar member apertures creating an obstruction in the passageway upstream of a deposited bill so that if a leash is attached to the bill, the bill cannot be retrieved from the passageway by pulling the leash.

4 Claims, 2 Drawing Sheets

ANTIFRAUD CURRENCY ACCEPTOR

FIELD OF THE INVENTION

The present invention relates generally to paper currency acceptors, and more particularly to a paper currency acceptor having an antifraud device to prevent the unauthorized removal of currency therefrom during use.

BACKGROUND OF THE INVENTION

In these days of escalating prices, paper currency acceptors have become well known, their usage being commonly applied to vending machines and the like, which often require deposit of money in amounts inconvenient to carry in coin Examples of such units can be found in my U.S. Pat. No. 4,884,671 and in the patents cited therein.

Since these paper currency acceptors are used for the unattended collection of money, usually in connection with the sale of goods, the users of these devices who are inclined to larceny are often in situations where their attempts to defraud such currency acceptors will not be observed. One of the simplest manners of defrauding such devices, known as "stringing", involves the attachment of a "leash" to a legitimate bank note. The leash is most commonly a piece of string taped to the bill, but may also be wire, long strips of tape, mylar ribbons or the like, and other means for attachment may likewise be substituted. The defrauder will typically deposit the modified bill into a currency acceptor, and use the leash to pull the bank note therefrom after using the credit accrued from the deposit and validation of the otherwise legitimate security. Obviously, the susceptability of paper currency acceptors to this manner of defrauding constitutes a serious problem.

Numerous attempts have been made to solve this problem such as providing a slotted drum in the transport path of the currency, the slot in the drum defining a portion of the pathway. After the bill passes through the slotted drum, the drum is rotated to a position where the slot is out of alignment with the pathway so that the pathway is occluded and the note cannot pass reversely therethrough. Such a system requires components that are costly to manufacture and assemble, and requires precision positioning means to ensure that the drum slot is properly aligned with the currency passageway.

Other attempts to solve the problem employ paired meshing transport rollers which are made of resilient material, and are strongly biased against one another to effectuate tightly gripping engagement with the deposited bank note passing therethrough. Such systems are subject to accelerated wear of these transport rollers, thus reducing their grip upon the bank note. The transport rollers of such a mechanism are subject to the accumulation of containments from the processed bills, thus requiring frequent cleaning to maintain necessary friction. Accordingly, if such systems are not maintained frequently, they can become susceptible to such defrauding schemes.

Consequently, a need exists for a paper currency acceptor having an antifraud device which is easy and inexpensive to manufacture and assemble, requires little or no maintenance, and is positively resistant to stringing.

OBJECTS AND ADVANTAGES

It is an object of the present invention to provide an antifraud device for a paper currency acceptor which is positively resistant to stringing.

It is another object of the present invention to provide an antifraud device for a paper currency acceptor which is easily manufactured and assembled.

It is another object of the present invention to provide an antifraud device for a paper currency acceptor which is not susceptible to contamination from the processing of bank notes.

It is yet another object of the present invention to provide an antifraud device for a paper currency acceptor which has a single moving part.

It is a further object of the present invention to provide a paper currency acceptor having an antifraud device satisfying the above objects.

Other objects and advantages of the instant invention will become obvious to those of skill in the art upon contemplation of the disclosure herein.

SUMMARY OF THE INVENTION

According to the present invention, a paper currency acceptor is provided, having an antifraud currency stop comb assembly. The currency stop comb assembly comprises an elongated backing plate having front and rear planar surfaces parallel to the panel walls defining the currency pathway. The long dimension of the backing plate is oriented transversely to the longitudinal axis of the currency pathway, and the backing plate is attached directly to the armature of a linear actuating solenoid so that the back planar surface of the backing plate faces the solenoid, and so that the longitudinal axis of the armature is oriented at an angle normal to the planar surfaces of the comb backing plate. Extending frontwardly from the backing plate are a pluarlity of tines or blades, the tines being arranged in one or more rows. Thus, the comb mounted to the armature forms the singular moving part of the antifraud device of the instant invention.

The walls of the currency pathway have a series of tine receiving slots or apertures therethrough, each of the slots being positioned in alignment with the longitudinal axis of one of the tines, so that when the armature of the solenoid is extended, the stop comb tines pass through the tine receiving slots, and the currency pathway. In this position, each row of tines forms an occluding gate oriented transversely across the longitudinal axis of the currency pathway, so that a bank note having a leash attached thereto cannot be retrieved after deposit by means of pulling the leash.

Conversely, when the solenoid or armature is retracted, the tines of the stop comb are withdrawn from the currency pathway, and the currency pathway is in an unobstructed state, allowing the normal passage of currency through the pathway.

DETAILED DESCRIPTION

Figure 1:
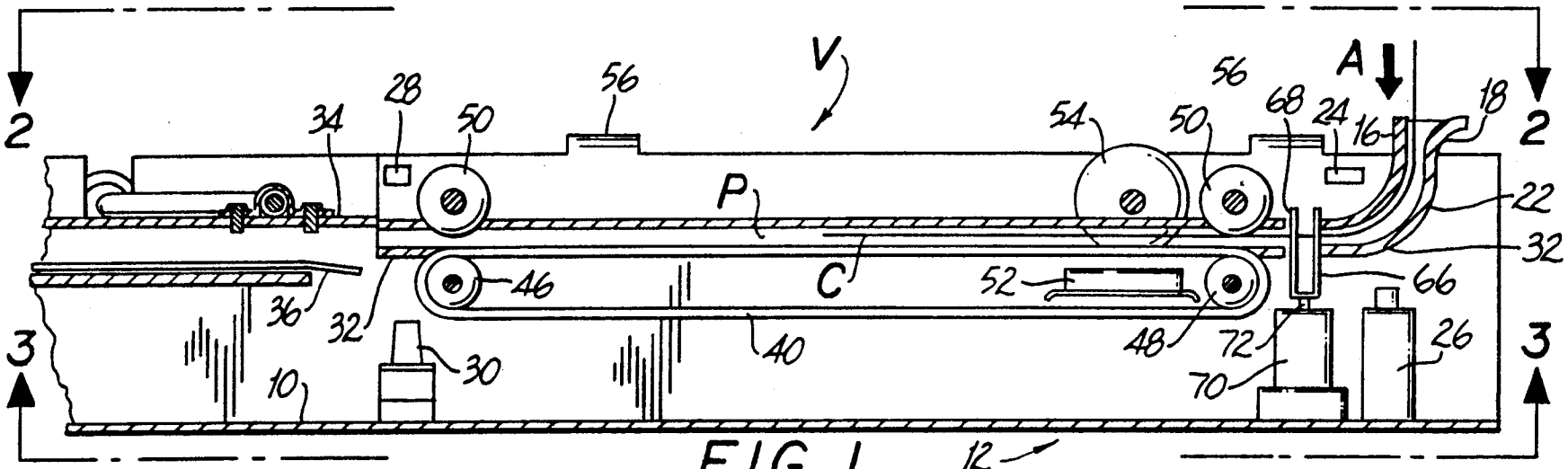
FIG. 1 is a sectional side view of a currency acceptor showing the details of the escrow station embodying the present invention and a partial view of the storage station.

Briefly, the conventional currency acceptor, (the storage areas being only partially shown) comprises a U-shaped body generally designated by the numeral 10 in FIG. 1, includes a validation station 12 and a storage section 14. The validation station 12 is formed of an inner and outer nested U-shaped troughs 16 and 18 defining between them a currency pathway P in which paper currency C is received upon deposit by a purchaser using the vending machine or other device equipped with the paper currency acceptor 10. Paper currency C is tendered to an inlet slot 20, located at the upstream end of pathway P and which is accessible through the enclosure of the unit in which the acceptor 10 is installed. Immediately downstream of inlet slot 12, pathway P traverses a 90 degree bend 22, which allows the mechanism to be economically mounted to the inside surface of the front panel of a vending machine or the like.

Located a short distance downstream from inlet slot 20 is a light source 24 such as an LED and a photosensor 26 such as a phototransistor, paired on opposite sides of pathway P so that the tender presence and position of a deposited bill is detected immediately on entry of the currency C into the bend 22. Similarly, at a point near the end of the pathway P, corresponding to where a bill would be fully positioned in the validation station 12, another pair of light source 28 and photosensor 30 are located. The troughs 16 and 18 have holes 32 through their planar surfaces aligned with the paired light sources and photosensor in pathway P. The downstream end 34 of pathway P opens onto a pair of spaced rails 36 within the storage station 14.

Figure 2:
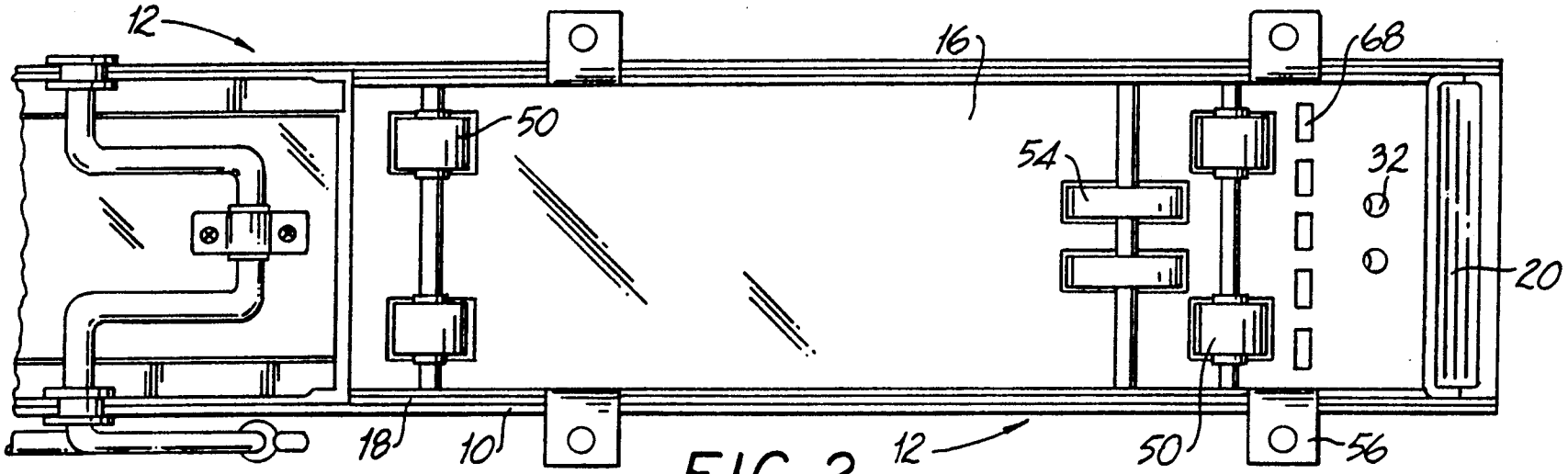
FIG. 2 is a plan view of the currency acceptor taken in the direction 2—2 shown in FIG. 1.
Figure 3:
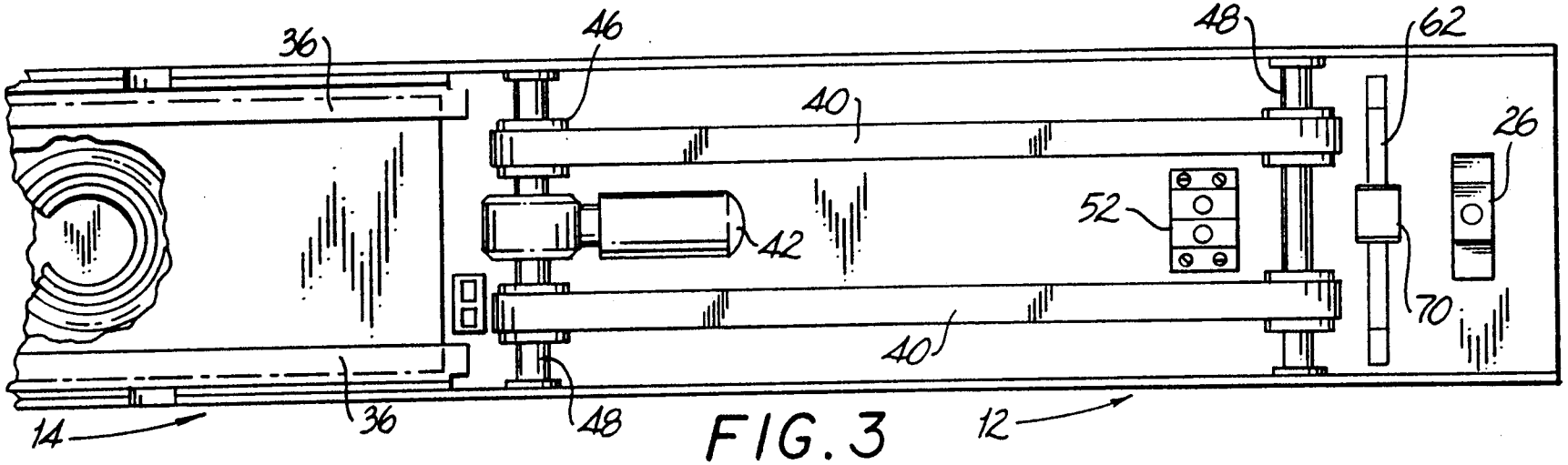
FIG. 3 is a plan view of the currency acceptor section shown in FIG. 1 taken along the line 3—3.

Currency is transported from the inlet 20 downstream along pathway P, by an endless conveyor comprising a pair of spaced belts 40 driven by motor 42 (FIG. 2) connected through transmission 44. The belts 40 are positioned around driven rollers 46 and passive rollers 48 journalled in the body 10 which extend through slots in the outer trough 18 so that one run of the drive belts 40 project slightly into pathway P to frictionally engage paper currency in pathway P. Mounted on the inner trough to pass through slots are rollers 50 oriented opposite the belts 40 so as to project into pathway P to engage the currency C and cooperatively guide it through pathway P. The motor 42 is reversible so that the currency may be transported downstream along pathway P by rotating motor 42 in one direction, and conversely may be reversed upstream and ejected from pathway P through inlet slot 20 by rotating motor 42 in the opposite direction.

Magnetic head 52 for evaluating the currency, is mounted between the spaced belts 40 so that the planar surface of currency transported along pathway P slides across head 52 to determine the authenticity and denomination of the bill deposited by sensing unique information present only in legitimate currency. A pair of idler rolls 54 are mounted above the head 52. The apparatus is provided also with extending tabs 56 by which it can be affixed to the vending machine.

In operation, currency C is placed in inlet slot 20, and sensed by the upstream photosensor 26, starting motor 42 which causes the bill to be drawn across head 52 by belts 40 until the front edge of the currency is sensed by the downstream photosensor 30 which stops the motor 42. The depositor is credited with the appropriate value if the bill is validated and the evaluationh system is responsive to the head 52. If not, the motor 42 is run in the opposite direction, ejecting the tendered instrument upon the insertion and sensing of a subsequent currency bill by the upstream photosensor 26. During the period when no subsequent bill is introduced, the first currency bill remains in "escrow" in the validation station. The currency C is moved into the storage station 14 only when a subsequent bill is sensed by the upsteam sensor 26. The storage station is appended directly to the end of the validation station so that upon transport out of the downstream end 34 of the validation station, the currency C is delivered to the storage station where it is stacked for safe keeping and ultimate removal.

Full details of the currency acceptor 10, as briefly described herein can be found in my U.S. Pat. No. 4,884,671 to which reference is hereby made as if more fully set forth herein.

While the apparatus described above prevents most acts of fraud, i.e. deposit of counterfeit money, photocopied money and the like, such apparatus remains susceptible to the method of defrauding known as "stringing". According to the present invention, this fraud is prevented by implementing a safe escrow function through the employment of a gate mechanism shown in FIGS. 4-6 and generally defined by the numeral 60 which can selectively obstruct pathway P so that the unauthorized removal of a deposited bill as by stringing is prevented.

Figure 6:
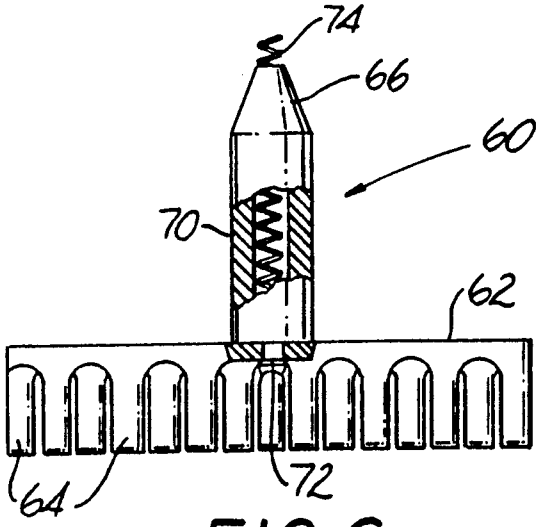
FIG. 6 is a partially sectional elevation view of the comb and its actuator assembly.

The antifraud gate mechanism 60 comprises a stop comb-like structure having an elongated spine 62 and a plurality of tines 64 arranged in two parallel rows. The stop comb is mounted on a linear actuator 66 for reciprocating movement. The actuator is mounted on the base of the housing 10 to move the stop comb relative to the pathway P so that the tines 64 are caused to pass through small slots 68 in both the trough 16 and trough 18. The actuator as seen in FIG. 6 is preferably a solenoid 70 such as LEDEX P/N TDS-06A, having an armature 72 selectively achieving either an extended or retracted armature position dependent upon the electrical current supplied. The solenoid 70 is mounted on the base of the housing 10 so that armature 72 is oriented perpendicularly to the planar surfaces of pathway P at a position downstream of the photosensor 26, but upstream of drive belts 40. The end of armature 72 within the coil body of the solenoid has a central counterbore and compression spring 74 therein to bias the armature in an extended position causing the stop comb normally into the pathway P to occlude the pathway P when current to solenoid 70 is interrupted.

The end of armature 72 is joined to the spine 62 of the comb by peening, swagging, welding, screwing or otherwise fastening the armature and comb together. Assembled as shown in FIG. 6, the free ends of the tines are oriented toward pathway P, with their longitudinal axis perpendicular to the planar surfaces of pathway P, and the tine rows are oriented transversely with respect to the longitudinal axis of pathway P.

Figure 5:
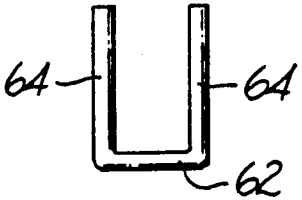
FIG. 5 is an end view of the stop comb showing double row tine arrangement.
Figure 4:
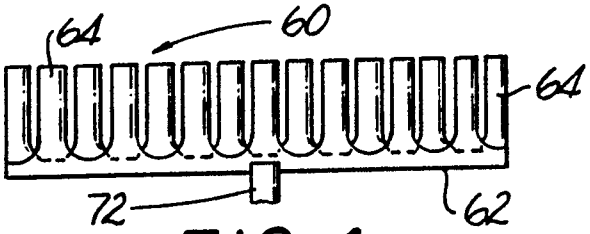
FIG. 4 is a side elevational view of the stop comb of the present invention.

In operation, when solenoid 70 is energized, armature 72 is drawn into the retracted position, overcoming the normal biasing force of spring 74, causing the tines 64 to be withdrawn from the pathway P. When solenoid 72 is de-energized, the armature 70 is returned to the normal extended position, causing tines 66 to pass entirely through aperture slots 68 so as to form a blocking gate occluding pathway P. As illustrated in FIG. 4–6, the tines of each row are preferably arranged having alternating positions along the length of spine 54, to minimize the gaps therebetween.

Such an arrangement enables substantially total occlusion of pathway P when a currency bill is fully in the validation station and/or no new bill is being introduced. The dimensions of apertures 68 preferably permit passage of tines 64 therethrough very closely, and the free ends of tines 64 are sharpened so that a leash or paper extension attached to deposited currency will be severed upon engagement of comb 52 in pathway P.

The operation of the gate mechanism can be easily integrated to the control circuitry shown in my aforementioned U.S. Pat. No. 4,884,671 or any other conventional control circuitry. Using the circuitry shown in my aforementioned patent, when a bill C is inserted in slot 20, its presence is sensed by photosensor 26 and the motor 42 is energized to cause the bill C to be transportred by belts 40 downstream in pathway P and across magnetic head 52. The same signal as is sent to the motor 42 is fed to solenoid 70 causing it to retract the armature 72, pulling the tines 64 out of its normal biased position occluding the pathway P. When the bill C reaches downstream photosensor 30, corresponding to the position where bill C has passed entirely across head 52, the motor 22 is stopped and the same signal used to de-energize the solenoid 70 allowing the spring to drive tines 64 back through the slots 68 to occlude the pathway P preventing the bill C from being pulled backward through the inlet 20.

If bill C is determined not to be legitimate, or if the vending machine in which acceptor is used has some problem, such as insufficient change or being empty of the merchandise desired by the depositor, the validation cannot be completed. As a result, the motor 42 is rotated reversely, causing belts 40 to transport bill C upstream in pathway P back out of inlet 20 for retrieval by the depositor. The same signal to reverse the motor 42 is used again to energize solenoid 70 retracting the tines from pathway P leaving the pathway P free for reverse movement of the bill C. Otherwise stop comb remains extended, occluding pathway P, securing bill C in escrow, and credit is issued for use by the depositor.

While the above description contains many specificities, these should not be construed as limitations of the scope of the instant invention, but rather an exemplification of the preferred embodiment thereof. Accordingly, the scope of the instant invention should not be determined by the embodiment shown, but rather by the claims appended hereto, and their legal equivalents.

What is claimed is:

1. An antifraud paper currency acceptor comprising a) an inlet for the receipt of paper currency bills fed individually thereto;

b) first means for detecting the insertion of each bill into said inlet;

c) a pair of parallel, relatively spaced planar members defining a passageway therebetween for transport of the bills longitudinally therethrough, the upstream end of the passageway aligned with said inlet;

d) means for transporting the bills downstream along the passageway, said transport means being responsive to said insertion sensing means;

e) second means for sensing the authenticity and denomination of each bill deposited as the bill transported downstream along the passageway from said inlet, said authenticity and denomination sensing means being located along the passageway at a point downstream of said bill insertion sensing means;

f) third means for sensing a second position of the bill in the passageway, the second position corresponding to a bill position attained when the entire bill has passed said means for sensing authenticity and denomination;

g) gate means for occluding the passageway holding said bill captive;

h) said gate means comprising a linear actuator and a stop comb, said linear actuator comprising a solenoid and an elongated armature, said armature being retracted along its longitudinal axis into the body of said linear actuator in a first actuator position, and said armature extending along its longitudinal axis outwardly from the body of said linear actuator in a second actuator position;

said linear actuator being responsive to the cooperative sequential operation of said second and third sensing means so that said armature remains in extended position while said bill is retained at the second position, and is initiated upon the sensing that said bill is authentic and said transport means has moved said bill from said second position downstream thereof to free said second position for a subsequent bill;

i) said actuator being mounted in the acceptor so that said armature is oriented perpendicularly to the planar surfaces of said passageway defining members, and substantially centered along the transverse axis of said passageway, and extending theretoward when said linear actuator is changed from said first actuator position to said second actuator position;

j) said stop comb having an elongated spine and plurality of elongated parallel tines extending therefrom, said tines being further arranged in spaced relationship in at least one row, said spine being fastened directly to the end of said armature nearer the passageway so that said tines extend toward the passageway from said spine, and so that said tines are parallel to the longitudinal axis of said armature;

k) said stop comb being further oriented so that the longitudinal axis of said spine is oriented transversely to the longitudinal axis of the passageway;

l) each said planar member having a tine receiving aperture in coaxial alignment with the longitudinal axis of each said tine so that when said actuator is moved to said second position, said armature forces said comb toward the passageway causing said tines to be received in said tine receiving apertures of both said planar members, thereby creating an obstruction in the passageway;

m) said actuator being further positioned so that said tines engage the apertures of said planar members at a location simultaneously upstream of the bill in said second bill position and downstream of said insertion sensing means.

2. The apparatus as set forth in claim 1, said stop comb further having two rows of said tines, said tines of each row having alternating positions along the lingitudinal axis of said stop comb spine.

3. The apparatus as set forth in claim 1, said tine receiving apertures further being of dimension to closely receive said tines, and said tines further being sharpened at their ends nearest the passageway so that when said tines are forced into said apertures, a leash in the passageway attached to the deposited bill will be severed.

4. The apparatus as set forth in claim 3, said armature having a stud extending from said end of said armature nearest the passageway, said stud having a lesser diameter than the body of said armature, and said spine having a hole therethrough of dimension to closely receive said stud, the central axis of the hole in said spine being parallel to the longitudinal axes of said armature and said tines, said stud being inserted through the hole in said spine, and the free end of said stud peened over so that said stop comb is securely fastened to said armature.

* * * * *